350-96.24 SR
2/2/88 XR 4,722,620

United States Patent [19]

Igi et al.

[11] Patent Number: 4,722,620

[45] Date of Patent: Feb. 2, 1988

[54] PRINTER WITH AN IMAGE READER

[75] Inventors: Hisashi Igi, Nagoya; Eiichi Ohta, Handa; Yasuhito Bandai; Kazuhiko Takagi, both of Nagoya, all of Japan

[73] Assignee: Brother Kogyo Kabushiki Kaisha, Japan

[21] Appl. No.: 813,642

[22] Filed: Dec. 26, 1985

[30] Foreign Application Priority Data

Dec. 29, 1984 [JP] Japan ..... 59-199959[U]

[51] Int. Cl.[4] ..... B41J 3/44

[52] U.S. Cl. ..... 400/73; 400/82; 400/352; 350/96.24

[58] Field of Search ..... 400/73, 70, 82, 105, 400/352, 354, 355–358, 174, 175, 320, 88, 580; 350/96.24, 96.25, 96.27

[56] References Cited

U.S. PATENT DOCUMENTS

| | | | |
|---|---|---|---|
| 3,803,388 | 4/1974 | Williamson et al. | 400/73 |
| 3,918,029 | 11/1975 | Lemelson | 400/73 |
| 3,953,730 | 4/1976 | Henry et al. | 350/96.24 |
| 4,168,533 | 9/1979 | Schwartz | 400/88 |
| 4,227,644 | 10/1980 | Sakano | 400/580 |
| 4,350,448 | 9/1982 | Hanagata et al. | 400/175 |
| 4,405,207 | 9/1983 | Kay | 350/96.25 |
| 4,418,371 | 11/1983 | Menden | 400/320 |
| 4,491,919 | 1/1985 | Corby, Jr. | 350/96.24 |
| 4,523,235 | 6/1985 | Rajchman | 400/73 |
| 4,555,715 | 11/1985 | Vegeais et al. | 400/175 |
| 4,589,143 | 5/1986 | Baur et al. | 400/73 |

FOREIGN PATENT DOCUMENTS

| | | | |
|---|---|---|---|
| 3421228 | 11/1984 | Fed. Rep. of Germany | 400/580 |
| 3343907 | 6/1985 | Fed. Rep. of Germany | 400/73 |
| 38190 | 2/1985 | Japan | 400/73 |

OTHER PUBLICATIONS

Loiselle, "Fiber-Optic Light Source", IBM Technical Disclosure Bulletin, vol. 20, No. 5, p. 1820, 10/77.

*Primary Examiner*—William Pieprz
*Attorney, Agent, or Firm*—Parkhurst & Oliff

[57] ABSTRACT

A printing apparatus with an image reading device, having a platen extending along a line of printing, a guide rod extending parallel to the platen, a carriage movable on the guide rod, and a printing head which is mounted on the carriage to effect a printing operation a recording medium on the platen. The image reading device comprises: a pair of support portions which slidably engage the guide rod so as to sandwich the carriage in a direction parallel to the line of printing; a bridging portion connecting the support portions such that the support portions are immovable relative to each other; an image-reading portion supported immovably relative to the support portions and the bridging portion, and having an operative position adjacent to the surface of the recording medium, for reading images on the surface; and a control circuit fixed to the bridging portion, for controlling an image-reading operation of the image-reading portion.

6 Claims, 5 Drawing Figures

PRINTER WITH AN IMAGE READER

BACKGROUND OF THE INVENTION

Field of the Invention

The present invention relates in general to a printing apparatus having an image reading device, and more particularly to such a printing apparatus having a platen extending along a line of printing, a guide rod extending parallel to the platen, a carriage movable on the guide rod, a printing head mounted on the carriage, and the image-reading device movable with the carraige, to effect printing and image-reading operations along the line of printing on a recording medium on the platen as the carriage is moved on the guide rod along the platen.

SUMMARY OF THE INVENTION

It is an object of the present invention to provide a printing apparatus with an image reading device, which has a simple support arrangement for mounting the image reading device and a carriage with a printing head on a common guide rod, with a minimum space requirement for these elements supported on the guide rod, and which permits the carriage and the image reading device to be moved as a unit on the guide rod, with a minimum rotational displacement about an axis perpendicular to the guide rod, and relative to the platen in directions toward and away from the platen.

Another object of the invention is the provision of such a printing apparatus wherein a control circuit for controlling an image-reading operation are incorporated in the image reading device with a minimum space requirement.

According to the present invention, there is provided a printing apparatus with an image reading device, having an elongate platen extending along a line of printing, a guide rod extending parallel to the elongate platen, a carriage movable on the guide rod, and a printing head which is mounted on the carriage to effect a printing operation along the line of printing on a recording medium on the platen as the carriage is moved on the guide rod, the image reading device comprising: (a) a pair of support portions which slidably engage the guide rod so as to sandwich the carriage in a direction parallel to the line of printing; (b) a bridging portion which connects the pair of support portions such that the support portions are immovable relative to each other; (c) an image-reading portion supported immovably relative to the support portions and the bridging portion, and having an operative position adjacent to the surface of the recording medium on the platen, for reading images on the surface; and (d) a control circuit fixed to the bridging portion, for controlling an image-reading operation of the image-reading portion.

In the printing apparatus of the present invention constructed as described above, the carriage carrying the printing head is movably supported on the guide rod such that the carriage is sandwiched between the pair of support portions of the image reading device in a direction parallel to the line of printing, i.e., in the direction of movement of the carriage. The support portions of the image reading device are also supported on the same guide rod such that they slidably engage the guide rod. Thus, the carriage and the image reading device are compactly supported on the single common guide rod with a minimum space required for the carriage, print head and the image reading device. Further, the above-indicated support arrangement wherein the support portions of the image reading device which sandwich the carriage are spaced from each other with a relatively long span therebetween along the guide rod. This spaced-apart arrangement of the support portions assures a minimum rotational displacement of the carriage and the image reading device about an axis perpendicular to the guide rod, and relative to the platen toward and away from the platen. Furthermore, the control circuit for controlling an image-reading operation of the image reading device is fixed to its bridging portion which connects the pair of support portions. Therefore, the control circuit is installed by utilizing a space occupied by the bridging portion of the image reading device.

According to one advantageous embodiment of the invention, the bridging portion extends below said carriage, to connect the pair of support portions.

According to another advantageous embodiment of the invention, the control circuit is fixed to a lower surface of the bridging portion.

According to a further embodiment of the invention, the image reading device further comprises a plurality of light-emitting optical fibers, and a plurality of light-receiving optical fibers. First ends of the light-emitting optical fibers and first ends of the light-receiving optical fibers are fixed adjacent to each other on the image-reading portion. The control circuit includes a plurality of light-emitting elements for emitting beams of light which are transmitted through the light-emitting optical fibers toward the surface of the recording medium. The control circuit further includes at least one light-sensitive element for receiving the beams of light reflected from the surface of the recording medium through the light-receiving optical fibers. Second ends of the light-emitting optical fibers opposite to the first ends thereof are positioned opposite to the light-emitting elements, while second ends of the light-receiving optical fibers opposite to the first ends thereof are positioned opposite to the at least one light-sensitive element.

In accordance with a still further advantageous embodiment of the invention, the image-reading device further comprises an arm portion which extends from one of the pair of support portions in a direction away from an axis of the guide rod, the image-reading portion being disposed on a distal end of the arm portion remote from the one of the support portions.

According to a preferred embodiment of the invention, the image reading device is supported by the guide rod pivotally between the operative position and an inoperative position away from the operative position in a direction away from the surface of the recording medium. It is noted, however, that the arrangement for pivotal movement of the image reading device about the guide rod is not essential to the printing apparatus of the present invention.

BRIEF DESCRIPTION OF THE DRAWING

The above and other objects, features and advantages of the present invention will become more apparent from reading the following detailed description of a preferred embodiment of the invention, when considered in connection with the accompanying drawing, in which.

DETAILED DESCRIPTION OF THE PREFERRED EMBODIMENT

Referring to FIGS. 1–5, a preferred form of a printing apparatus with an image reading device implementing the concept of the present invention will be described in detail for the purpose of illustration.

Figure 1:
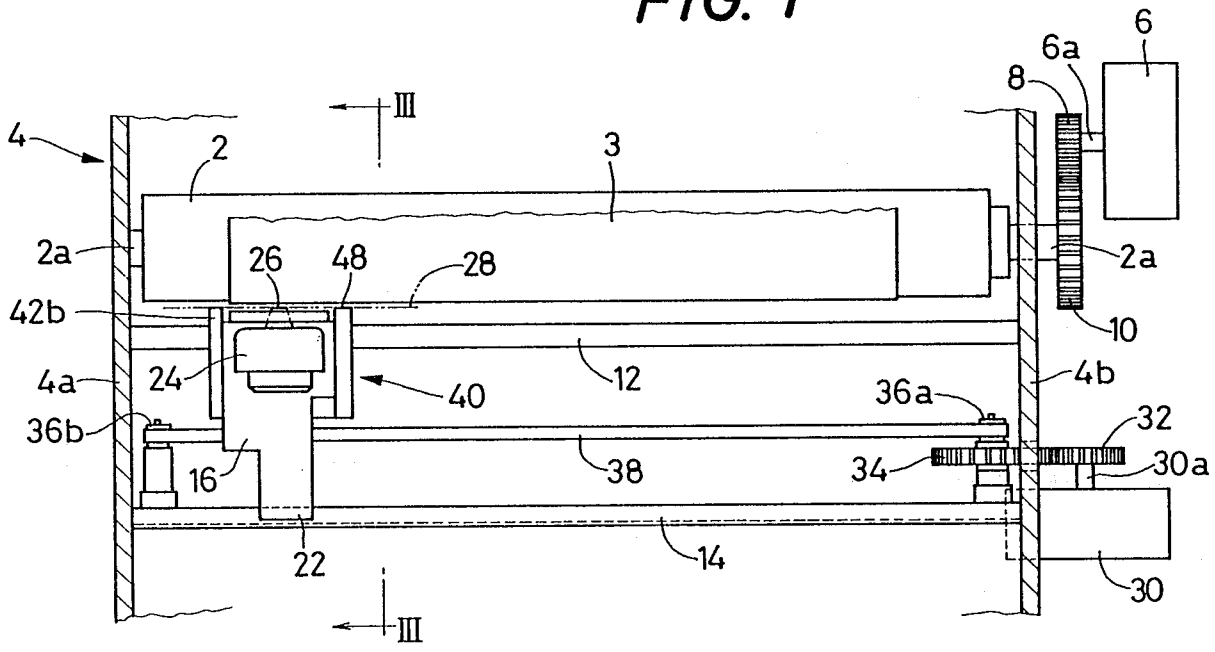
FIG. 1 is a fragmentary plan view of one embodiment of a printing apparatus with an image reading device of the present invention.
Figure 2:
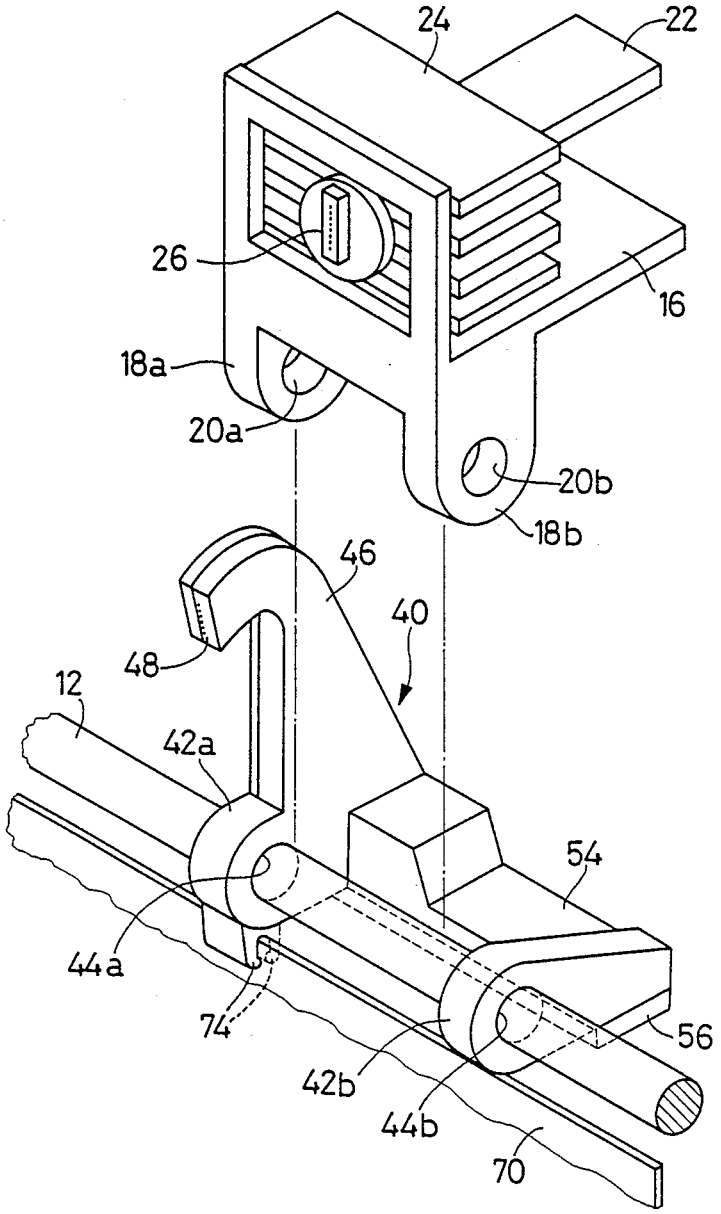
FIG. 2 is a fragmentary exploded view in perspective of the printing apparatus of FIG. 1.
Figure 3:
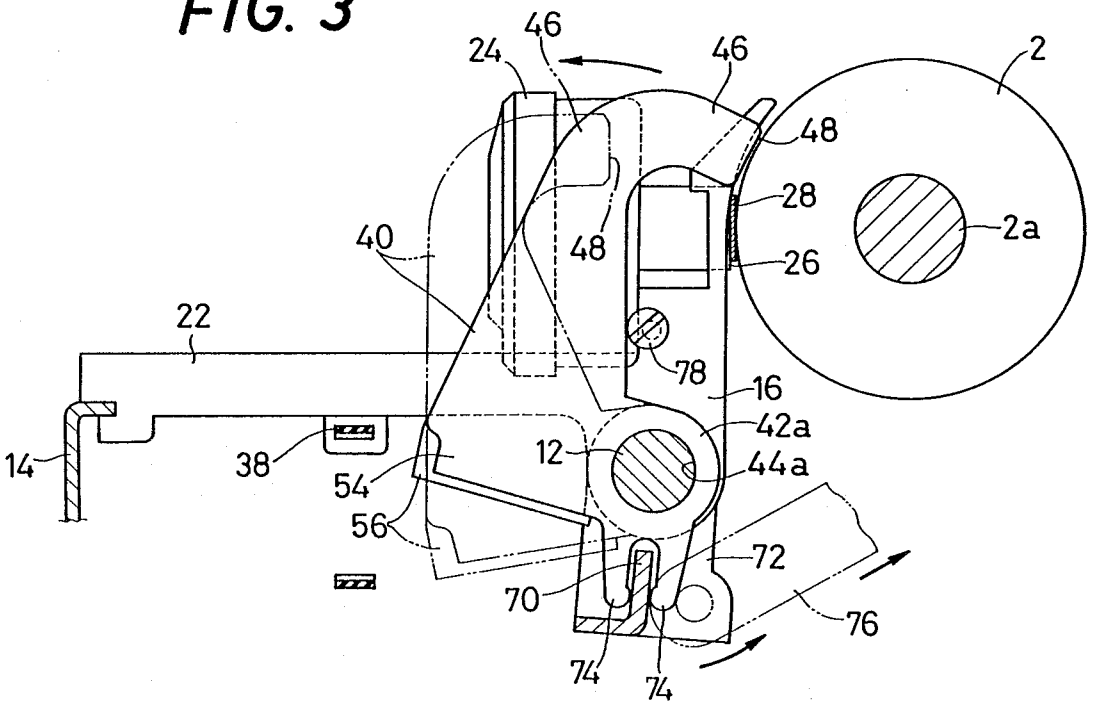
FIG. 3 is a fragmentary elevational view in cross section taken along line 111—111 of FIG. 1.

There are shown in FIGS. 1–3 a structural arrangement of the printing apparatus, wherein a generally elongate platen 2 in the form of a roller is rotatably supported at their bearing end portions 2*a* by a pair of side walls 4*a*, 4*b* of a frame 4 of the printing apparatus. The platen 2 extends along a line of printing to be effected on the apparatus, in order to support a recording medium in the form of a sheet of paper 3, as shown in FIG. 1. The platen 2 is rotated about its axis by a paper feed drive motor 6 via an output shaft 6*a* of the motor 6, a first gear 8 connected to the output shaft 6*a*, and a second gear 10 which is connected to the end of one of the bearing end portions 2*a* of the platen 2 and which meshes with the first gear 8. With the drive motor 6 operated in one of opposite directions, the sheet of paper 3 on the platen 2 is fed in the corresponding direction across the line of printing. In front of the platen 2, there are disposed a guide rod 12 and a guide rail 14 which are supported by the pair of side walls 4*a*, 4*b*, so as to extend parallel to the platen 2.

As most clearly shown in FIG. 2, a carriage 16 is formed with a pair of support portions 18*a*, 18*b* which are spaced apart from each other by a suitable distance along the guide rod 12. The support portions 18*a*, 18*b* have bores 20*a*, 20*b*, respectively, which slidably engage the guide rod 12. Thus, the carriage 16 is slidably supported by the guide rod 12. The carriage 16 is further provided with a plate-like front extension 22 which slidably engage the guide rail 14, as most clearly shown in FIG. 3. On the carriage 16, there is fixedly mounted a printing head 24 having a printing portion 26. With the carriage 16 slidably supported on the guide rod 12 and the guide rail 14, the printing portion 26 is positioned adjacent and opposite to the circumferential surface of the platen 2, as indicated in FIG. 3. Between the printing portion 26 and the surface of the platen 2, an active portion of an ink ribbon 28 is passed, so that a desired printing is effected by means of an ink on the ink ribbon. The ink ribbon 28 is supplied from a ribbon cassette (not shown) supported on the frame 4 in a known manner.

The carriage 16 is slidably moved on the guide rod 12 and the guide rail 14 along the platen 2, by a carriage drive motor 30, via an output shaft 30*a* of the motor 30, a third gear 32 connected to the output shaft 30*a*, a fourth gear 34 which meshes with the third gear 32, a first pulley 36*a* which is supported adjacent to the side wall 4*b*, rotatably with the fourth gear 34, and a timing belt 38 which connects the first pulley 36*a* and a second pulley 36*b* which is rotatably supported adjacent to the side wall 4*a*. The timing belt 38 is fixed to the carriage 16, so that a rotary motion of the drive motor 30 is imparted to the carriage 16. A printing operation on the sheet of paper 3 on the platen 2 is effected at the printing portion 26 through the ink ribbon 28 while the printing head 24 on the carriage 16 is moved along the platen 2.

The guide rod 12 also supports an image reading device 40 comprising a pair of support portions 42*a*, 42*b* each of which has a bore 44*a*, 44*b*. The support portions 42*a*, 42*b* are spaced apart from each other by a suitable distance along the guide rod 12, and slidably engage the guide rod 12 at their bores 44*a*, 44*b*, such that the carriage 16 is sandwiched between the support portions 42*a*, 42*b* in a direction along the guide rod 12, as most clearly shown in FIG. 2. The distance between the support portions 42*a*, 42*b* is selected so that the support portions 18*a*, 18*b* of the carriage 16 are located adjacent to the corresponding support portions 42*a*, 42*b*. Thus, the carriage 16 and the image reading device 40 are slidably movable on the guide rod 12 as a unitary member such that the image reading device 40 is moved by the carriage 16. Further, the image reading device 40 is pivotable about the guide rod 12, relative to the carriage 16, as described later in detail.

Figure 4:
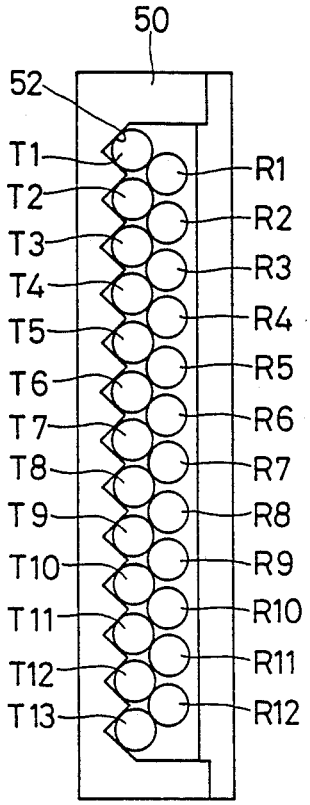
FIG. 4 is an enlarged view showing reading the ends of tow rows of optical fibers retained at an image-reading portion of the image reading device.

The image reading device 40 further comprises an arm portion 46 which extends from the support portion 42*a*, in an upward direction away from the axis of the guide rod 12. The arm portion 46 terminates at its distal end into an image-reading portion 48, at which first ends of light-emitting optical fibers T1–T13 and light-receiving optical fibers R1–R12 are retained in two parallel rows adjacent to each other, as shown in FIG. 4 and as described later in detail. Thus, the image-reading portion 48 is supported by the arm portion 46 immovably relative to the support portion 42*a* from which the arm portion 46 extends. With the image reading device 40 pivotally supported by the guide rod 12, the image-reading portion 48 is pivotable between its operative position adjacent to the surface of the platen 2, above the active portion of the ink ribbon 28, as indicated in FIG. 3 in solid line, and an inoperative position which is away from the operative position in a direction away from the surface of the platen 2, as indicated in FIG. 3 in phantom line.

As indicated above, the optical fibers T1–T13 and R1–R12 are disposed at their first ends in two parallel rows at the image-reading portion 48. As shown in FIG. 4, the image-reading portion 48 has a fiber holder plate 50 which has a serrated surface with a series of projections which define thirteen grooves 52 that are equally spaced from each other in the direction in which the two rows of the optical fibers T1–T13 and R1–R12 extend. The first ends of the light-emitting optical fibers T1–T13 are held in engagement with the corresponding grooves 52. In the meantime, the first ends of the light-receiving optical fibers R1–R12 are held in contact with the first ends of the adjacent light-emitting optical fibers T1–T13, such that the first ends of the optical fibers R1–R12 are displaced relative to the first ends of the optical fibers T1–T13 along the rows of the optical fibers, by a distance equal to a half of the pitch in which the first ends of the optical fibers T1–T13 are disposed.

Figure 5:
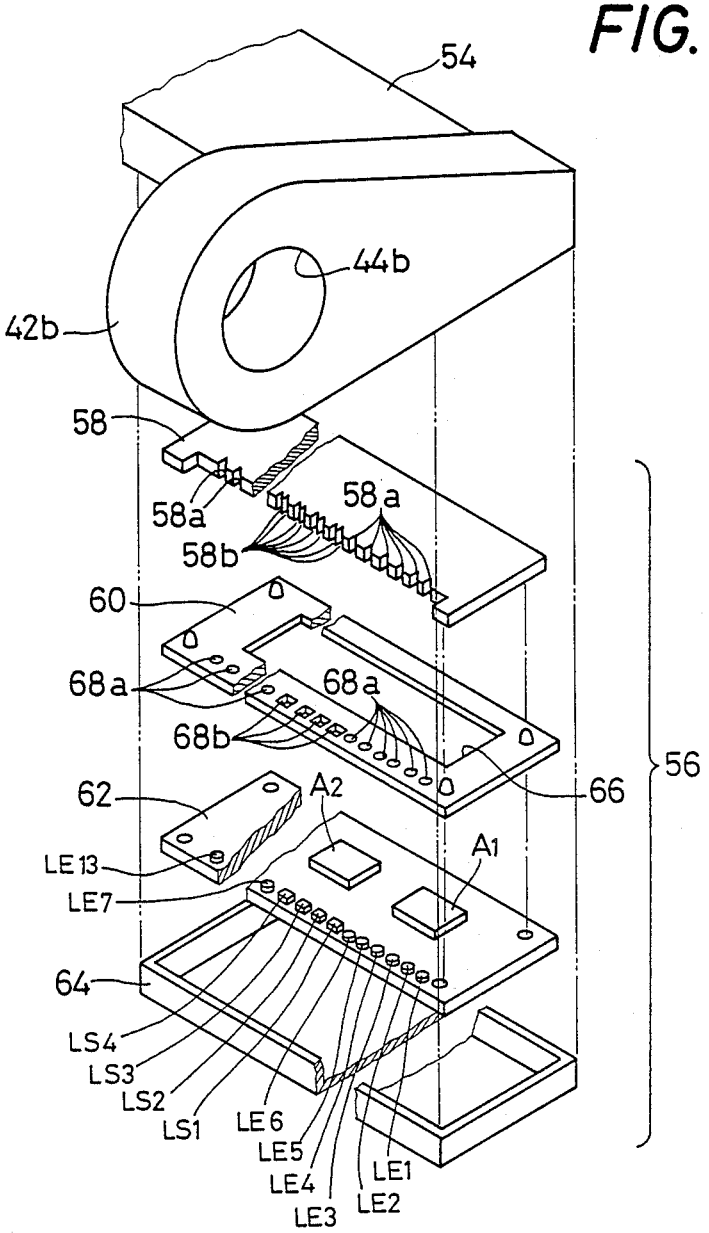
FIG. 5 is a fragmentary exploded perspective view of an arrangement of a control circuit incorporated in a bridging portion of the image reading device.

The image reading device 40 further comprises a bridging portion 54 which extends below the carriage 16, parallel to the guide rod 12, so as to connect the pair of support portions 42*a*, 42*b* so that the support portions 42*a*, 42*b* are not movable relative to each other. The bridging portion 54 houses an image-reading control assembly 56 as illustrated in FIG. 5. The control assembly 56 includes a retainer plate 58, a shielding plate 60, a printed-wiring board 62, and a bottom casing 64. The retainer plate 58 has thirteen grooves 58*a* for holding the second ends of the thirteen light-emitting optical fibers T1–T13, and eight grooves 58*b* for holding the second ends of the light-receiving optical fibers R1–R12. The eight light-receiving optical fibers, for example, R1–R4 and R7–10, are held in direct engagement with the eight grooves 58*b*, and the remaining four light-receiving optical fibers R5, R6, R11 and R12 are held in contact with the appropriate adjacent two optical fibers R1 and R3, R2 and R4, R7 and R9, and R8 and R10, respectively. Thus, the optical fibers R1, R3 and R5 constitute a first group, the optical fibers R2, R4 and R6 a second group, the optical fibers R7, R9 and R11 a third group, and the optical fibers R8, R10 and R12 a fourth group.

The shielding plate 60 is disposed below the retainer plate 58, and has an elongate rectangular opening 66, and further has thirteen round holes 68*a* alighed with the second ends of the light-transmitting optical fibers T1–T13, and four square holes 68*b* alighed with the second ends of the four groups of the optical fibers R1–R12, respectively. The printed wiring board 62, which is disposed below the shielding plate 60, is adapted to hold four amplifiers A1–A4 (only A1 and A2 shown), thirteen light-emitting elements LE1–LE13, and four light-sensitive elements LS1–LS4. The amplifiers A1–A4 are accommodated in the rectangular opening 66 formed in the shielding plate 60. The light-emitting elements LE1–LE13 are positioned so that second ends of the light-emitting optical fibers T1–T13 are located opposite to the elements LE1–LE13, respectively, in order to receive beams of light emitted by these elements LE1–LE13. The light-sensitive element LS1 is positioned opposite to the second ends of the first group of light-receiving optical fibers R1, R3 and R5, so that the element LS1 receive beams of light transmitted through these optical fibers. In the same way, the light-sensitive elements LS2–LS4 are positioned opposite to the second ends of the second, third and fourth groups of light-receiving optical fibers R2, R4 and R6; R7, R9 and R11; and R8, R10 and R12. The bottom casing 64 cooperates with the bridging portion 54 to accommodate the retainer plate 58, shielding plate 60 and printed wiring board 62 which are superposed on each other.

Referring back to FIGS. 2 and 3, an elongate actuator member 70 is disposed below the guide rod 12, extending parallel to the guide rod. This actuator member 70 is supported at its opposite longitudinal ends 72 by the corresponding opposite ends of the guide rod 12, pivotally about the axis of the guide rod 12. The support portion 42*a* of the image reading device 40 from which the arm portion 46 extends, is formed with a bifurcated engagement portion 74 which slidably engage the actuator member 70 so as to sandwich the same. The actuator member 70 is pivotally operated between two positions by a suitable drive means such as a motor, via a lever 76 operatively connected to the drive means. With the actuator member 70 operated between its two positions, the image-reading portion 48 is moved between its operative position shown in solid line in FIG. 3, and its inoperative position shown in phantom line in the same figure, as previously described. The carriage 16 has a stopper pin 78 on its right-hand side surface. This stopper pin 78 determines the operative position of the image-reading portion 48. The pin 16 is eccentrically rotatable so as to adjust its stop position, that is, the operative position of the image-reading portion 48.

There will be described the operation of the printing apparatus which is constructed as described hitherto.

In reading images on the sheet of paper 3 held on the platen 2, the image-reading portion 48 of the image reading device 40 is located at its operative position adjacent to the platen 2, as indicted in solid line in FIG. 3. The carriage 16 and the image reading device 40 mounted thereon are slidably moved on the guide rod 12 (and the guide rail 14) along the platen 2, by the drive motor 30 via the timing belt 38 and other power transmission members previously described. As the image reading device 40 is thus moved along the platen 2 relative to the sheet of paper 3, the images on the sheet of paper 3 are read by the image-reading portion 48. More specifically, beams of light are emitted from the light-emitting elements LE1–LE13, and transmitted through the light-emitting optical fibers T1–T13 from their second ends to their firest ends at the image-reading portion 48. Thus, the beams of light are radiated toward the surface of the sheet of paper 3. The beams of light reflected by the paper surface are received by the light-receiving optical fibers R1–R12 and transmitted therethrough to the corresponding light-sensitive elements LS1–LS4. In response to the intensity of the light beam received, each light-sensitive element LS generates a signal, which is applied to the respective amplifier A. The output of the individual amplifiers A1–A4 are fed to a suitable controller for judging whether a particular reading spot on the sheet of paper 3 includes a portion of an image or not. Details of the reading operation are described in pending U.S. application Ser. No. 726,314, filed Apr. 24, 1985, which was assigned to the same assignee as the present application.

Since the support portions 42*a*, 42*b* of the image reading device 40 are spaced from each other along the guide rod 12, by a relatively large distance which is greater than the width of the carriage 16, the image reading device 40 is protected from its rotational displacement about an axis perpendicular to the guide rod 12, and relative to the platen 2 in the directions toward and away from the surface of the platen 2. As a result, the image-reading portion 48 can be accurately positioned relative to the sheet of paper 3 on the platen 2, which permits improved reading accuracy and reliability.

When a printing on the sheet of paper 3 is achieved, the actuator member 70 is operated to move the image reading device 40 pivotally about the guide rod 12, to place the image-reading portion 48 at its inoperative or retracted position shown in phantom line in FIG. 3. In this position, the carriage 16 and the image reading device 40 are moved along the platen, while the printing portion 26 effects printing of images on the sheet of paper 3 via the ink ribbon 28. Since the image-reading portion 48 is retracted away from the platen 2, the image-reading portion 48 is protected from otherwise possible contamination by ink particles which are removed from the ink ribbon 28 during the printing operation.

Since the carriage 16 is disposed between the support portions 42*a*, 42*b* and positioned above the bridging portion 54 of the image reading device 40, it is possible to save a space required for the carriage 16 and the image reading device 40. Further, the above support arrangement eliminates a structure for connecting the carriage 16 and the image reading device 40 to move them as a unit.

While the present invention has been described in its preferred embodiment, it is to be understood that the invention is not confined to the precise details of the illustrated embodiment, but may be embodied with changes, modifications and improvements which may occur to those skilled in the art, without departing from the spirit and scope of the invention defined in the appended claims. For example, it is possible to form the image reading device such that its bridging portion 54 extends over the carriage 16. In this case, the control assembly 56 may preferably disposed on the upper surface of the bridging portion.

Although the image reading device 40 of the illustrated embodiment of the invention use the optical fibers T1–T13 and R1–R12, the light-emitting elements LE1–LE13, and the light-sensitive elements LS1–LS4, it is possible to use other types of image reading sensors such as charge-coupled devices (CCD) or other solid-state image sensors.

What is claimed is:

1. A printing apparatus with an image reading device, having an elongate platen extending along a line of printing, a guide rod extending parallel to the elongate platen, a carriage in slidable engagement with and movable on the guide rod, and a printing head which is mounted on the carriage to effect a printing operation along said line of printing on a recording medium on the platen as the carriage is moved on the guide rod, said image reading device comprising:

a pair of support portions which slidably engage said guide rod and are disposed in a spaced-apart relation from each other so as to sandwich said carriage in a direction parallel to said line of printing, wherein said support portions are immovable relative to said carriage in said direction;

a bridging portion which connects said pair of support portions such that the support portions are immovable relative to each other;

an image-reading portion supported immovably relative to said support portions and said bridging portion, and having an operative position adjacent to the surface of said recording medium on said platen, for reading images on said surface; and a control circuit fixed to said bridging portion, for controlling an image-reading operation of said image-reading portion.

2. A printing apparatus with an image reading device according to claim 1, wherein said bridging portion extends below said carriage, to connect said pair of support portions.

3. A printing apparatus with an image reading device according to claim 1, wherein said control circuit is fixed to a lower surface of said bridging portion.

4. A printing apparatus with an image reading device according to claim 1, wherein said image reading device further comprises a plurality of light-emitting optical fibers, and a plurality of light-receiving optical fibers, first ends of said light-emitting optical fibers and first ends of said light-receiving optical fibers being fixed adjacent to each other on said image-reading portion, said control circuit including a plurality of light-emitting elements for emitting beams of light which are transmitted through said light-emitting optical fibers toward said surface of the recording medium, and further including at least one light-sensitive element for receiving the beams of light reflected from said surface of the recording medium through said light-receiving optical fibers, second ends of said light-emitting optical fibers opposite to said first ends thereof being positioned opposite to said light-emitting elements, and second ends of said light-receiving optical fibers opposite to said first ends thereof being positioned opposite to said at least one light-sensitive element.

5. A printing apparatus with an image reading device according to claim 1, wherein said image-reading device further comprises an arm portion which extends from one of said pair of support portions in a direction away from an axis of said guide rod, said image-reading portion being disposed on a distal end of said arm portion remote from said one of the support portions.

6. A printing apparatus with an image reading device according to claim 1, wherein said image reading device is supported by said guide rod pivotally between said operative position and an inoperative position away from said operative position in a direction away from said surface of the recording medium.

* * * * *